United States Patent [19]

Lowe

[11] Patent Number: 4,490,958

[45] **Date of Patent: * Jan. 1, 1985**

[54] SHEET METAL BEAM

[76] Inventor: Colin F. Lowe, 5214 Sanford, Houston, Tex. 77035

[ * ] Notice: The portion of the term of this patent subsequent to May 18, 1999 has been disclaimed.

[21] Appl. No.: 542,775

[22] Filed: Oct. 17, 1983

Related U.S. Application Data

[63] Continuation-in-part of Ser. No. 217,709, Dec. 18, 1980, Pat. No. 4,409,771, which is a continuation-in-part of Ser. No. 104,286, Dec. 17, 1979, Pat. No. 4,329,824.

[51] Int. Cl.[3] ..... E04B 1/18

[52] U.S. Cl. ..... 52/634; 52/729; 52/732; 52/738

[58] Field of Search ..... 52/729, 732, 634, 738

[56] References Cited

U.S. PATENT DOCUMENTS

| | | | |
|---|---|---|---|
| 854,391 | 5/1907 | Voshardt . | |
| 991,603 | 5/1911 | Brooks | 52/729 X |
| 1,351,615 | 8/1920 | Brown et al. . | |
| 1,360,720 | 11/1920 | Brown et al. . | |
| 1,457,303 | 6/1923 | Higgins . | |
| 1,997,876 | 4/1935 | Sheldon . | |
| 2,065,378 | 12/1936 | King . | |
| 2,871,997 | 2/1959 | Simpson et al. . | |
| 3,300,839 | 1/1967 | Lichti | 52/729 X |
| 3,332,197 | 7/1967 | Hinkle | 52/731 |
| 3,342,007 | 9/1967 | Mason | 52/729 |
| 3,349,535 | 10/1967 | Balinski | 52/634 |
| 3,444,664 | 5/1969 | Fink, Jr. et al. | 52/732 |
| 4,047,354 | 9/1977 | Sutherland | 52/729 |
| 4,109,440 | 8/1978 | Bill | 52/721 |
| 4,117,641 | 10/1978 | Wells | 52/404 |
| 4,329,824 | 5/1982 | Lowe | 52/738 X |
| 4,409,771 | 10/1983 | Lowe | 52/729 |

FOREIGN PATENT DOCUMENTS

| | | | |
|---|---|---|---|
| 2524526 | 1/1976 | Fed. Rep. of Germany | 52/729 |
| 678165 | 8/1979 | U.S.S.R. | 52/729 |

*Primary Examiner*—Carl D. Friedman

*Attorney, Agent, or Firm*—Jacox & Meckstroth

[57] ABSTRACT

A panel of thin sheet metal is roll-formed into a beam having upper and lower first flange portions integrally connected by a web portion. The first flange portions are reinforced by corresponding second flange portions which may be separate or formed from the panel and folded back onto the corresponding first flange portion. The upper and lower flange portions may project in opposite directions from the web portion providing the beam with a Z-shaped cross-sectional configuration to facilitate close nesting of the beams in a stack, or the web portion may be disposed in the center of the flange portions to provide an "I" cross-sectional configuration. A plurality of parallel spaced stiffening ribs are formed in the web portion, and longitudinally extending stiffening ribs are formed in the flange portions. When the ribs in the web portion extend longitudinally of the beam, a series of longitudinally spaced strut members extend vertically between the flange portions adjacent the ribs and are attached to the flange and web portions. The strut members may extend through corresponding sets of aligned holes within the ribs or may conform to the ribbed configuration of the web portion. The second flange portions may also comprise separate heavier sheet metal strips which are attached to the first flange portions, and the strut members may be molded or cast from a flowable material.

17 Claims, 27 Drawing Figures

SHEET METAL BEAM

RELATED APPLICATION

This application is a continuation-in-part of application Ser. No. 217,709, filed Dec. 18, 1980, issued Oct. 18, 1983 as U.S. Pat. No. 4,409,771, which is a continuation-in-part of Ser. No. 104,286, filed Dec. 17, 1979, issued May 18, 1982 as U.S. Pat. No. 4,329,824.

BACKGROUND OF THE INVENTION

In the construction of a metal building, it is common to use a frame which supports parallel spaced steel beams or purlins to which corrugated sheet metal roof panels are attached. The purlins have a Z-shaped cross-sectional configuration, for example, as illustrated in U.S. Pat. No. 2,871,997, No. 3,290,845, No. 3,982,373 and No. 3,513,614. Similar Z-shaped beams are attached to the sides of the frames and are commonly referred to as wall girts for supporting the roll-formed sheet metal side wall panels. The most commonly used purlins are roll-formed from a relatively heavy gauge steel strip, such as fourteen gauge (0.074"), and have a height of approximately eight inches. Thus the flange portions of a purlin are integrally connected by the flat web portion, and all of the portions have a common uniform thickness which results in a weight of approximately 3.67 pounds per linear foot for an eight inch purlin.

While eight inch purlins are most commonly used because of its strength/weight ratio, purlins having a greater height, such as twelve inches, are also used in view of the fact that the strength of the purlin increases as the square of the height. However, as the flat web portion of a conventional purlin increases to provide the purlin with a greater height, the additional thickness of steel needed in the web portion adds little to the increased strength but substantially increases the weight of the purlin.

It has also been found desirable for the flange portions of a purlin to have a substantially flat outer surfaces to provide proper attachment of the purlins to the metal frame and of the roof panels to the purlins by suitable fasteners. While a one-piece conventional Z-shaped purlin may be efficiently manufactured by roll-forming, it does not provide maximum utilization of the strength of the steel and thus does not obtain the maximum strength/weight ratio. While there have been many other types of sheet metal beams either proposed or made, none of these beams have been found satisfactory for replacing the above described purlins commonly used in the construction of a metal building.

SUMMARY OF THE INVENTION

The present invention is directed to an improved sheet metal beam which obtains maximum utilization of the strength of the sheet metal in order to minimize the thickness or gauge of the sheet metal and to obtain a maximum strength/weight ratio. While the beam of the invention is ideally suited for use as a purlin in the construction of a metal building, the beam of the invention may also be used in the construction of other building structures and may also be used as a vertical column.

A beam constructed in accordance with the invention is also adapted to be efficiently manufactured at a significantly lower cost than the cost of manufacturing conventional metal beams or purlins, and further provides a significantly lower weight per linear foot of a beam so that the cost of handling and transporting the beam is significantly reduced. While a number of desirable features and advantages of beam constructed in accordance with the invention are apparent from the drawings, other features and advantages of the invention will be apparent from the following description and claims in reference to the drawings.

BRIEF DESCRIPTION OF THE DRAWINGS

FIG. 18 is an end view of another beam embodiment forming a modification of the beam shown in FIGS. 16-18;

DESCRIPTION OF THE PREFERRED EMBODIMENTS

Figure 1:
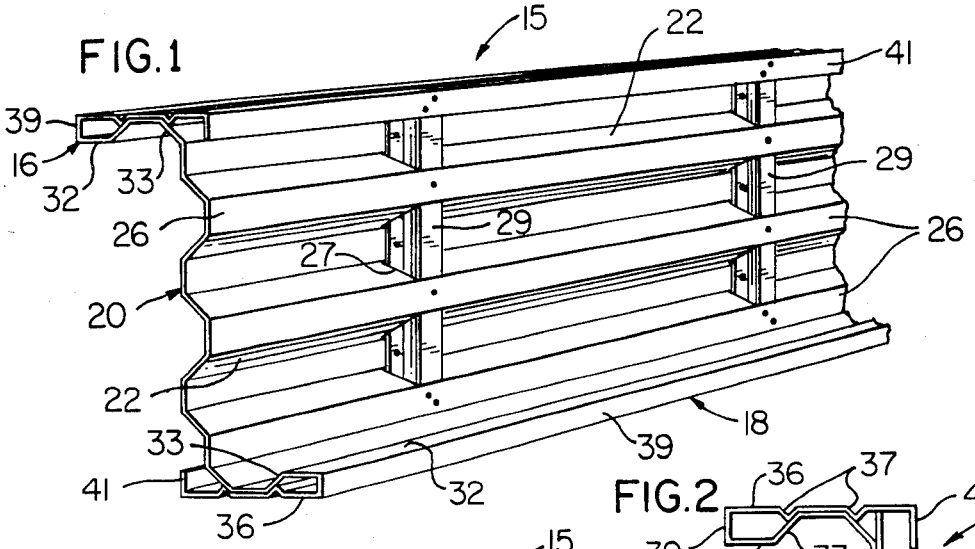
FIG. 1 is a perspective view of an end portion of a Z-shaped purlin or beam constructed in accordance with the invention.
Figure 2:
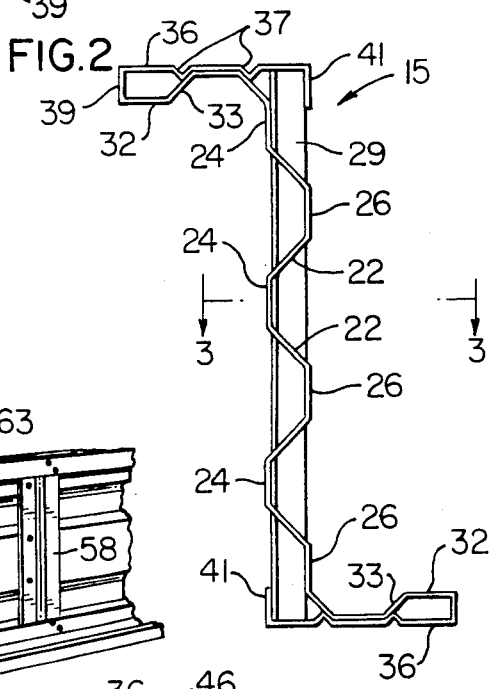
FIG. 2 is an end view of the beam shown in FIG. 1.
Figure 3:
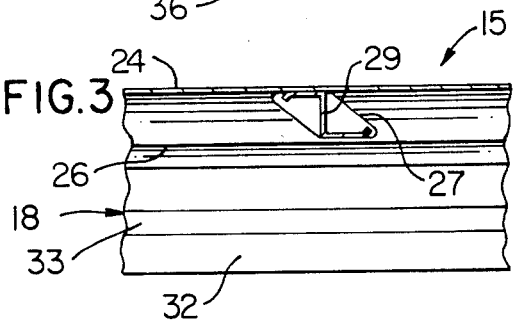
FIG. 3 is a fragmentary section taken generally on the line 3—3 of FIG. 2.

The sheet metal beam or purlin illustrated in FIGS. 1–3 is constructed of a relatively thin gauge sheet metal such as 24 gauge steel which is 0.024 inch in thickness. The beam 15 includes an upper flange 16 and a lower flange 18 which are integrally connected by a web portion 20. The flanges 16 and 18 project in opposite directions from the web portion 20 to provide the beam with a Z-shape cross-sectional configuration so that a number of the beams may be stacked in a close-fitted nested relation for shipping and storage purposes. The web portion 20 is roll-formed with a corrugated cross-sectional configuration to form a plurality of longitudinally extending ribs 22 which project from flat coplaner base wall portions 24. Each of the ribs 22 has a trapezoid cross-sectional configuration, and the outer flat wall portions 26 of the ribs 22 are substantially the same size as the base wall portions 24. Sets of parallelogram shaped holes 27 (FIG. 3) are formed within the ribs 22 at longitudinally spaced intervals along the beam 15, and a formed sheet metal strut 29 extends through each set of aligned holes 27. Each strut 29 corresponds in length to the height of the web portion 20 and has a Z-shaped configuration so that the flanges of the strut 29 may be conveniently spot-welded or otherwise fastened to both the outer flat walls 26 of the ribs 22 and the flat base wall portions 24, as illustrated in FIG. 2.

Each of the flanges 16 and 18 of the beam 15 are formed of integral sections of the sheet metal panel and include a first or inner flange portion 32 having a rib 33 of trapezoid cross-sectional configuration. The panel section is folded back upon itself to form a second or outer flange portion 36 which has a pair of longitudinally extending V-shaped ribs 37 for receiving the rib 33 on the inner wall portion 32. Preferably, the inner flange portion 32 and outer flange portion 36 are secured together by longitudinally spaced spot-welds located at the top of the rib 33. The flange portions 32 and 36 are thus integrally connected by an outer edge wall portion 39 which cooperates to provide the flange with a tubular or hollow outer edge portion. The outer flange portion 36 of each flange extends to form a right angle lip portion 41 which projects inwardly and is secured by spot-welds to the adjacent flange of each strut 29.

The struts 29 may be inserted into the corresponding sets of openings or holes 27 within the ribs 22 while the sheet metal panel is being roll-formed and before one of the outer flange portions 36 is folded back into engagement with its adjacent inner flange portion 32. After the struts 29 are inserted, the spot welding of the flat wall portions and lip portions 41 to the struts is progressively performed as another operation.

The construction of the beam 15 provides a substantially high strength/weight ratio as a result of the configuration of the flanges 16 and 18 and the integration of the struts 29 with the stiffening ribs 22. The ribs 33 within each of the flange portions 32 of the beam also cooperate with the lip portions 41 to form a rigid and braced connection of each flange to the web portion. The integration of the ribs 22 and struts 29 also minimizes the overall thickness of the web portion 20 thereby providing for closer nesting of the beams when arranged in stacked relation. The beam 15 may also be conveniently constructed entirely of light gauge sheet metal which has a galvanized or other protective coating to provide an outer surface more durable than paint.

Figure 4:
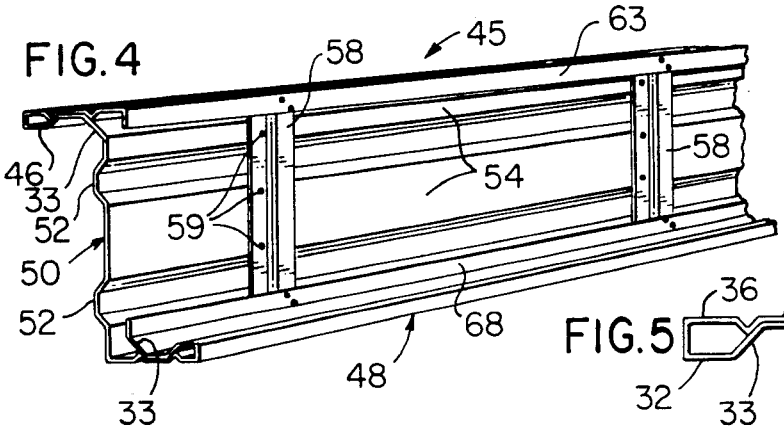
FIG. 4 is a perspective view similar to FIG. 1 and showing another embodiment of a beam constructed in accordance with the invention.
Figure 5:
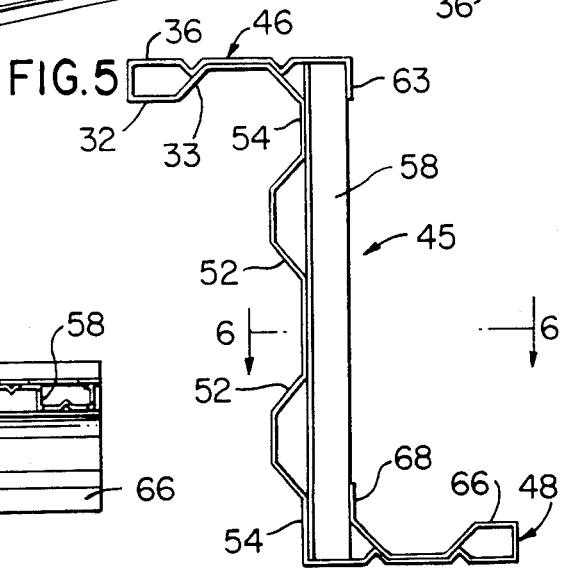
FIG. 5 is an end view of the beam shown in FIG. 4.
Figure 6:
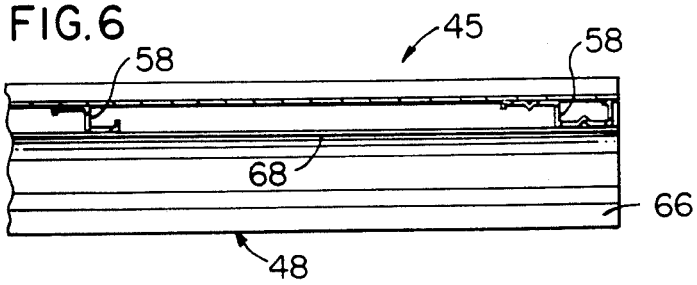
FIG. 6 is a fragmentary section taken generally on the line 6—6 of FIG. 5.

Referring to FIGS. 4–6 which illustrate another embodiment of a beam constructed in accordance with the invention, a beam 45 is roll-formed from a light gauge sheet metal, such as 24 gauge steel, and includes upper and lower flanges 46 and 48 which are integrally connected by a web portion 50 in a manner similar to the beam described above in reference to FIGS. 1–3. In the embodiment of FIGS. 4–6, the web portion 50 has two longitudinally extending ribs 52 which project from coplanar flat base wall portions 54, and a series of longitudinally spaced sheet metal struts 58 are positioned adjacent the base wall portions 54. The struts 58 are secured to the base wall portions 54 by fasteners or spot welds 59.

The upper flange 46 of the beam 45 is constructed substantially the same as the upper flange of the beam 15 and thus is identified with the same reference numbers. The flange has a corresponding lip portion 63 which projects downwardly or inwardly and is spot-welded to the struts 58. The lower flange 48 is also constructed similarly to the lower flange 18, except that the inner or second flange portion 66 has a lip portion 68 which is coplanar with the lip portion 63 and is also secured by spot welds to the struts 58. As shown in FIG. 6, in some beams it may be desirable for the strut member 58 located at the ends of the beam to be of a heavier sheet metal construction than the intermediate strut members 58 in order to carry the higher shear loads at the end portions of the beam. While the strength/weight ratio of the beam illustrated in FIGS. 4–6 is approximately that of the beam shown in FIGS. 1–3, the use of struts outside the web substantially lessens the nesting effectiveness. On the other hand, the beam 45 requires a somewhat lesser investment in tooling for manufacturing the beam.

Figure 7:
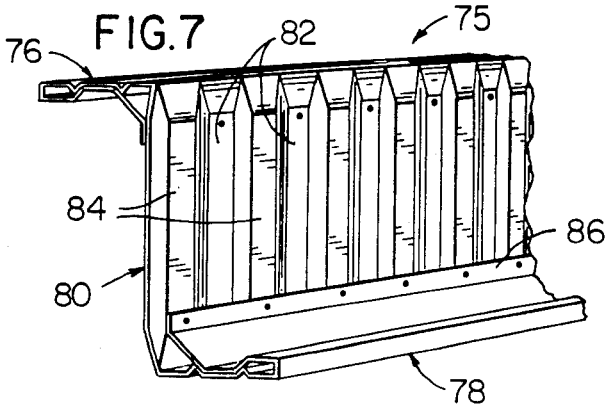
FIG. 7 is another perspective view similar to FIGS. 1 and 4 and showing another embodiment of a beam constructed in accordance with the invention.
Figure 8:
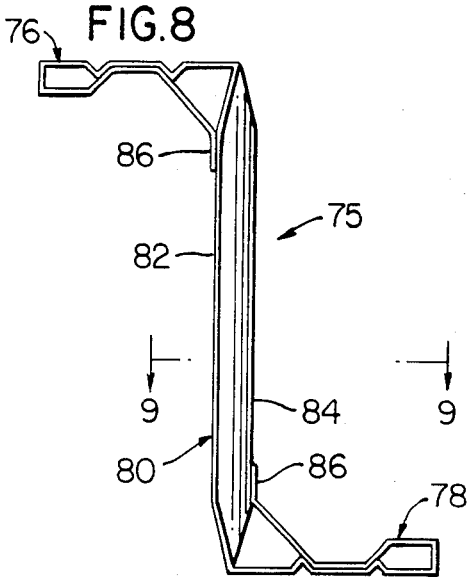
FIG. 8 is an end view of the beam shown in FIG. 7.
Figure 9:
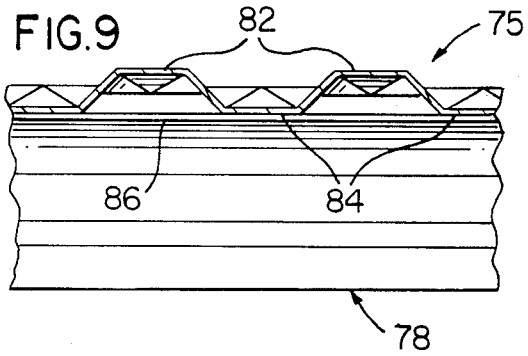
FIG. 9 is a fragmentary section taken generally on the line 9—9 of FIG. 8.

FIGS. 7–9 illustrates another embodiment of a purlin or beam 75 constructed in accordance with the invention and which is also adapted to be roll-formed from a light gauge sheet metal such as 24 gauge steel. The beam 75 includes an upper flange 76 and a lower flange 78 which are integrally connected by a web portion 80. The flanges 76 and 78 are roll formed to a configuration similar to the lower flange 48 of the beam 45 discussed above in connection with FIGS. 4–6, and thus required no further detail description. However, the web portion 80 of the beam 75 is impressed or formed with a series of longitudinally spaced and vertically extending ribs 82 each of which has a trapezoid cross-sectional configuration and projects from adjacent flat coplanar wall portions 84. The longitudinal spacing of the ribs 82 is preferably selected so that the web portion 80 of the beam 75 has uniform corrugations each formed by flat wall sections.

The inwardly projecting lip portions 86 of the flanges 76 and 78 are secured by spot welds to the outer flat wall sections of the ribs 82 and the flat wall sections 84 to provide the beam 75 with substantial rigidity and a high strength/weight ratio. While the beam 75 provides the desirable advantage of close nesting of adjacent beams in a stack, similar to the beam 15 disclosed above in FIGS. 1–3, the beam 75 requires separate progressive die tooling for forming the transverse ribs 82 which are formed in the sheet metal panel while it is generally flat and before roll-forming to produce the flanges 76 and 78.

Figure 10:
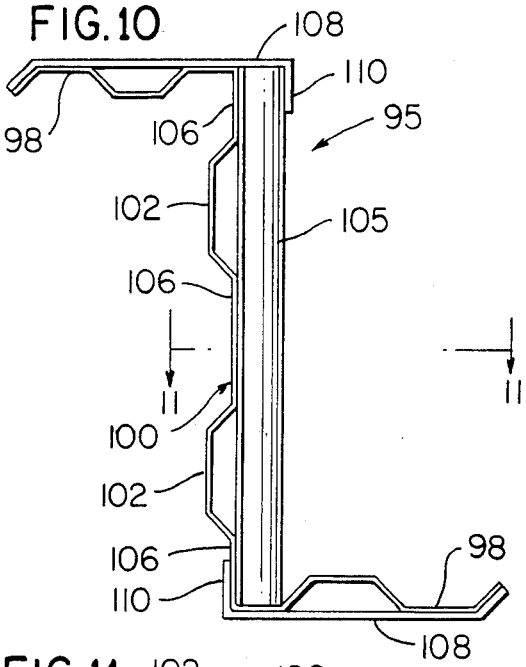
FIG. 10 is an end view of a beam constructed in accordance with a further embodiment of the invention.
Figure 11:
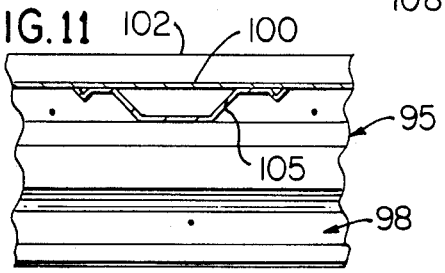
FIG. 11 is a fragmentary section taken generally on the line 11—11 of FIG. 10.

Referring to FIGS. 10 and 11, another sheet metal purlin or beam 95 is constructed in accordance with the invention and is roll-formed from a light gauge sheet metal panel to form flange portions 98 integrally connected by a web portion 100. The panel has a series of longitudinally extending ribs 102, with three of the ribs projecting from one side of the sheet metal panel and a fourth rib projecting from the opposite side of the panel. The roll-formed panel is then bent along two parallel longitudinal lines to form the flange portions 98 and the integrally connecting web portion 100. Thus each of the flange portions 98 is provided with one of the ribs 102, and the web portion 100 is provided with two of the ribs 102 each of which has a trapezoid cross-sectional configuration.

A series of longitudinally spaced and transversely extending struts 105 (FIG. 11) are spot-welded or riveted to the coplanar flat wall sections 106 of the web portion 100, and a formed sheet metal second flange portion or cap member 108 is attached by spot welds or other fasteners to each of the first flange portions 98 of the beam 95 to reinforce and stiffen the flange portion. As illustrated, each of the cap members 108 may be formed of a heavier gauge sheet metal and includes an inwardly projecting lip portion 110. The lip portion 110 of the upper cap member 108 is attached by spot welds to the outer flat wall sections of the struts 105, and the lip portion 110 of the lower cap member 108 is attached by spot welds to the lower flat wall section 106 of the web portion 100.

The purlin or beam 95 illustrated in FIGS. 10 and 11 is adapted to be manufactured with a lower tooling investment and a higher labor cost than required for producing the beams described above in reference to FIGS. 1–9. Thus the beam 95 is ideally suited for smaller volume production. In addition, the web portion 100 of the beam 95 may be more easily changed so that the beam may be produced according to the specific use of the beam.

Figure 12:
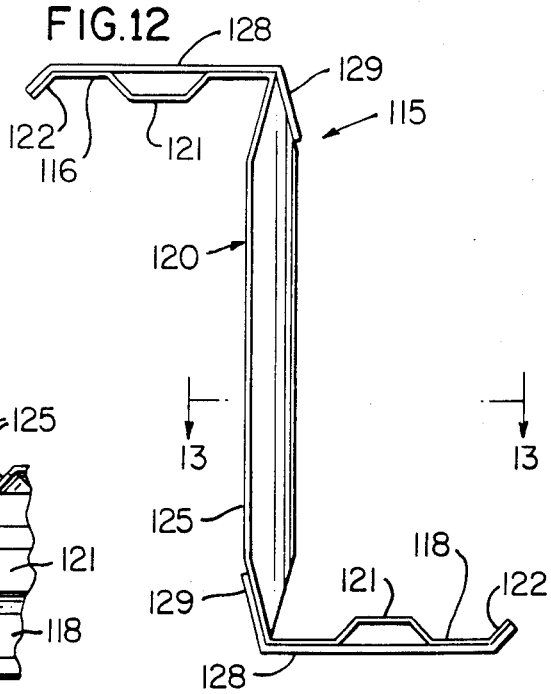
FIG. 12 is an end view, similar to FIG. 10, of a beam constructed in accordance with still another embodiment of the invention.
Figure 13:
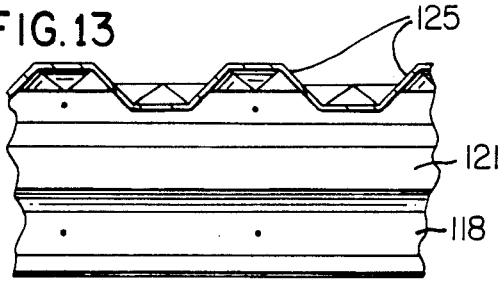
FIG. 13 is a fragmentary section taken generally on the line 13—13 of FIG. 12.

Another Z-shaped purlin or beam 115 constructed in accordance with the invention, is illustrated in FIGS. 12 and 13. In this embodiment, the beam 115 is formed of a thin gauge sheet metal panel in the same manner as the beam 75 to provide an upper flange portion 116 and a lower flange portion 118 integrally connected by a web portion 120. The flange portions 116 and 118 are roll-formed in a manner similar to the corresponding flange portions of the beam 95, and each flange portion includes a longitudinally extending stiffening rib 121 and an inclined edge portion 122. The web portion 120 of the beam 115 is formed in the same manner as the web portion 80 of the beam 75, that is, with longitudinally spaced and transversely or vertically extending ribs 125 each defined by flat wall sections forming a trapezoid cross-sectional configuration. Each of the flange portions 116 and 118 of the beam 115 is further reinforced by a second flange portion or cap member 128 which is preferably formed of a heavier gauge sheet metal and is attached by spot welds or rivets to the corresponding first or inner flange portion. Each of the cap members 128 also includes an inwardly projecting lip portion 129 which is spot welded or otherwise fastened to the web portion 120 to form a rigid second connection between the flange portions and the web portion 120.

Figure 14:
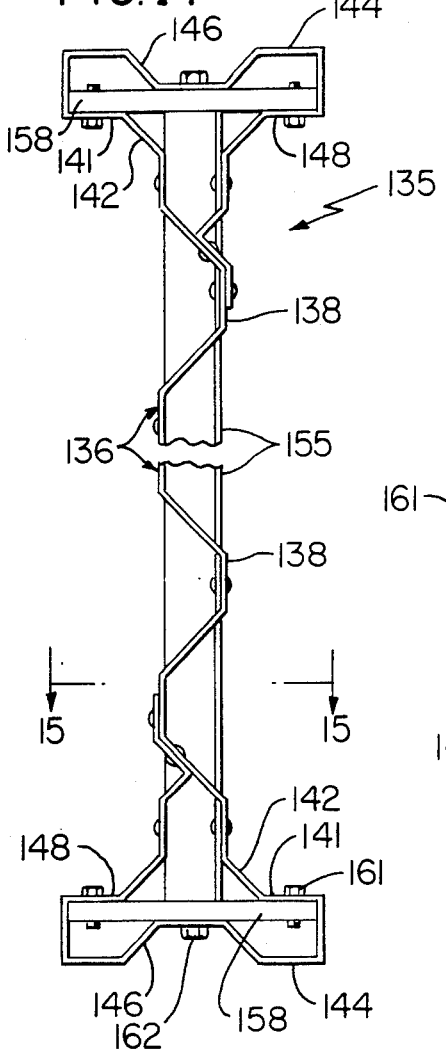
FIG. 14 is an end view of a sheet metal "I" beam constructed in accordance with a further embodiment of the invention.

Referring to FIG. 14 which illustrates an I-beam 135 constructed in a manner similar to the Z-shaped beam described above in reference to FIGS. 1—3, a sheet metal panel is roll-formed to produce a web portion 136 which has longitudinally extending and vertically spaced ribs 138 forming a corrugated vertical cross-sectional configuration. The sheet metal panel extends to form upper and lower first or inner flange portions 141 which are connected to the web portion by inclined or angled brace portions 142. The inner flange portions 141 are integrally connected to corresponding upper and lower outer flange portions 144 each of which has a longitudinally extending and inwardly projecting rib 146. From the upper and lower outer flange portions 144, the sheet metal panel returns inwardly to form upper and lower inner flange portions 148 which connect with the web portion 136 to provide each flange of the beam 135 with a hollow configuration. Each flange portion 148 may also be a separate strip.

Figure 15:
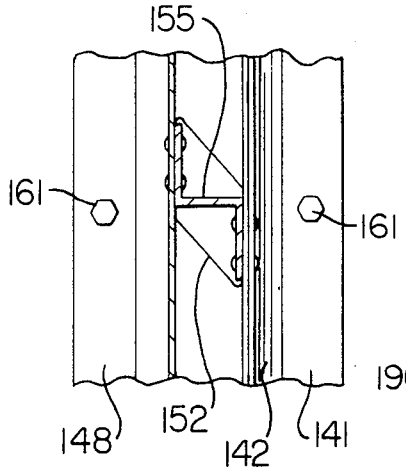
FIG. 15 is a fragmentary section taken generally on the line 15—15 of FIG. 14.

As shown in FIG. 15, the ribs 138 have longitudinally spaced sets of vertically aligned holes or openings 152. The sets of openings are spaced at longitudinal intervals, for example, at intervals of two to three feet, and each set of vertically aligned openings receives a formed sheet metal strut member 155 having a Z-shaped cross-sectional configuration. Each strut member 155 is secured by spot welds or rivots or other fasteners to the web portion 136 so that the strut members positively maintain the corrugated cross-sectional configuration of the web portion.

A separate flange strip 158 extends longitudinally of the beam within each of the upper and lower hollow flanges and seats on the adjacent ends of the struts 155. As shown in FIG. 14, each flange strip 158 is preferably formed of sheet steel having a substantially greater thickness than the thickness of the sheet metal panel forming the web portion 136 and flange portions 141 and 144 of the beam. A series of longitudinally spaced screws or fasteners 161 and 162 secure the flange portions 141, 144 and 148 to the corresponding adjacent flange strip 158 and cooperate to provide the beam 135 with a significantly higher strength/weight ratio, for example, in comparison to a conventional serpentine bar joist which may be replaced by the beam 135 with a significant cost savings. It is also within the scope of the invention to use heavier gauge sheet metal for forming the struts 155 in the areas of greatest stress and/or to use a heavier sheet metal web portion and/or closer spacing of the strut members.

Figure 16:
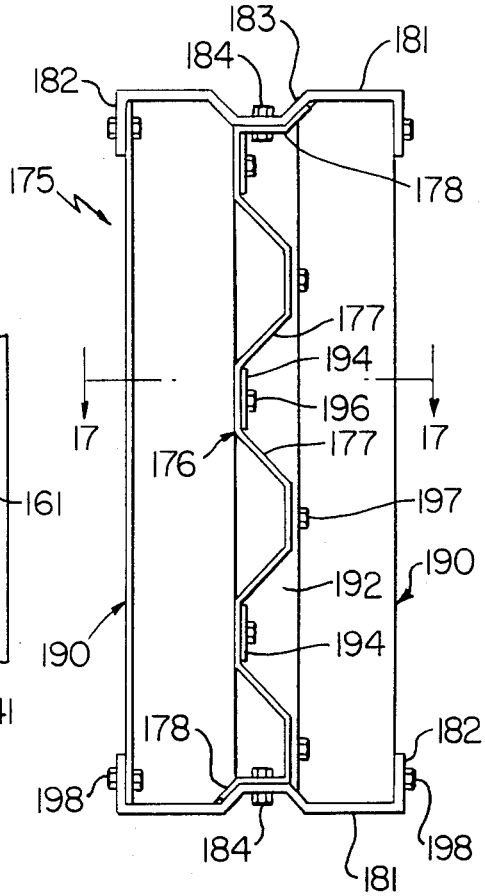
FIG. 16 is an end view of another beam constructed in accordance with the invention and showing the assembly of conforming strut members.
Figure 17:
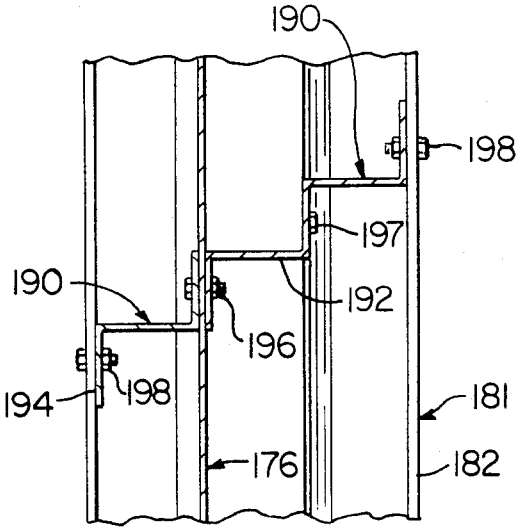
FIG. 17 is a fragmentary section taken generally on the line 17—17 of FIG. 16.
Figure 18:
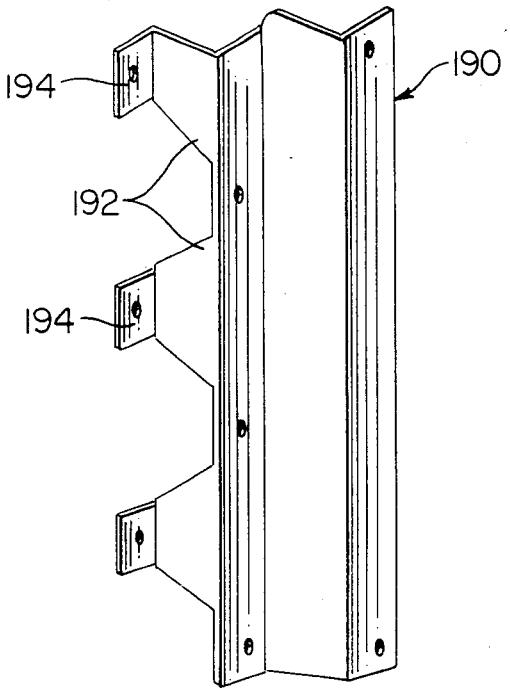
FIG. 18 is a perspective view of a strut member used in the embodiment shown in FIGS. 16 and 17.

Another form of I-beam construction is illustrated in FIGS. 16–18. In this embodiment, an elongated beam 175 includes a web portion 176 which is roll-formed from a sheet metal panel and includes longitudinally extending ribs 177. The panel also forms inner flange portions 178 each having a V-shaped rib. The beam 175 also includes outer flange portions or flange members 181 which are roll-formed from a heavier gauge sheet metal. Each of the outer flange members 181 includes longitudinally extending and inwardly projecting parallel edge sections or portions 182 and an intermediate rib 183 which is secured to the adjacent inner flange portion 178 by a series of longitudinally spaced spot welds or fasteners 184.

The beam 175 also includes a series of sheet metal strut members 190 (FIG. 18) which are arranged at longitudinally spaced intervals along each side of the web portion 176 and extend vertically between the upper and lower outer flange portions or members 181. Each of the strut members 190 has a main portion with a Z-shaped cross-sectional configuration and a set of vertically spaced ear portions 192 which are trapezoid in configuration and project into and between the ribs 177 of the web portion 176 in conforming relation. The ear portions 192 have right angle tabs 194 which are secured by spot welds or fasteners 196 and 197 (FIG. 17) to the web portion 176 and to the strut members 190 on the opposite side of the web portion. Fasteners 198 secure the strut members 190 the edge sections or portions 182 of the flange members 181.

The use of the double strut members 190 on opposite sides of the web portion 176 enables the beam 175 to be produced with relatively wide upper and lower outer flange members 181, and it is apparent that the strut members maintain the corrugated vertical cross-sectional configuration of the web portion 176 in addition to carrying the vertical loads between the upper and lower outer flange portions. The construction of the beam 175 also provides for flexibility in that the vertical height of the beam may be changed without requiring substantial changes in the tooling for roll-forming the sheet metal panel forming the web portion 176 and before the inner flange portions 178 are formed.

Figure 19:
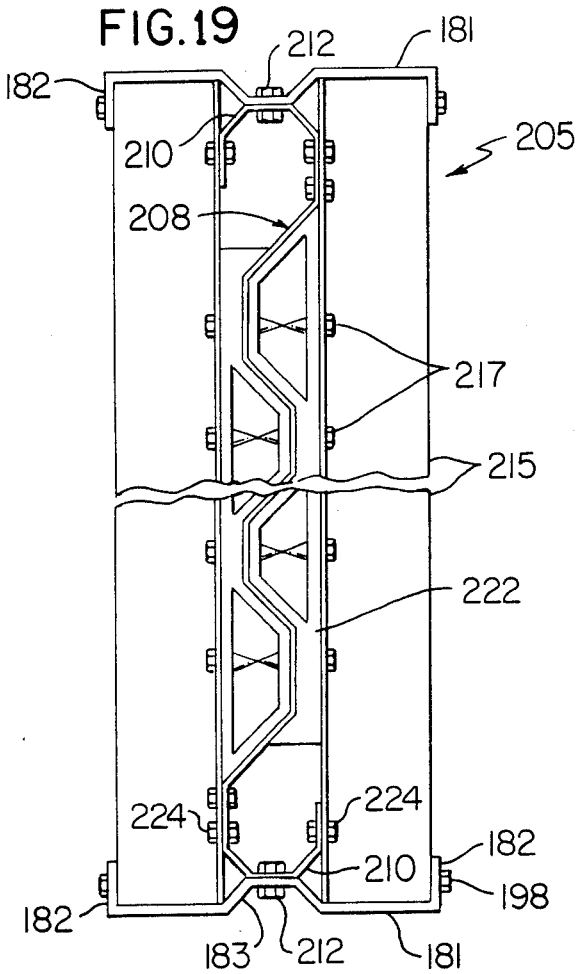

FIG. 19 illustrates another I-beam 205 which is constructed in a manner similar to the beam 175 described above in reference to FIGS. 16–18. The beam 205 includes upper and lower outer flange portions or members 181 which are identical to the outer flange portions or members 181 shown in FIG. 16. A substantially thinner sheet metal panel is roll-formed to form a web portion 208 having longitudinally extending ribs forming a vertical corrugated cross-sectional configuration. The sheet metal panel extends to form upper and lower inner flange portions 210 each of which has two V-shaped ribs forming a trapezoid cross-sectional configuration. The inner flange portions 210 are connected by longitudinally spaced fasteners 212 to the ribs 183 within the outer flange portions 181.

In the embodiment shown in FIG. 19, the beam 205 includes longitudinally spaced sheet metal strut members 215 each of which has a main portion with a Z-shaped cross-sectional configuration. The outer flange of each strut member 215 is secured by spot welds or fasteners 198 to the edges 182 of the outer flange portions 181, and the inner flange of each strut member 215 is secured by fasteners 217 to a web conforming member 222 having a vertical cross-sectional configuration mating with the corrugated cross-sectional configuration of the web portion 208. As shown in FIG. 19, preferably each of the web conforming strut members 222 is molded from metal as a die casting or from an injected plastics material so that the web conforming member 222 may be economically produced in high volume. Identical strut members 222 are used on opposite sides of the corrugated web portion 208, and fasteners 224 secure the upper and lower flange portions 210 to the inner flanges of the sheet metal strut members 215. The construction of the beam 205 also provides for producing beams of different heights without requiring substantial additional tooling for producing each component of the beam. For example, the length or height of the Z-shaped sheet metal strut members 215 may be easily changed for changing the height of the beam 205, the outer flange portions 181 remain the same, and the height of the web portion 208 may be changed by adding or deleting another rib before the upper and lower flange portions 210 are formed, for example, on a press brake.

Figure 20:
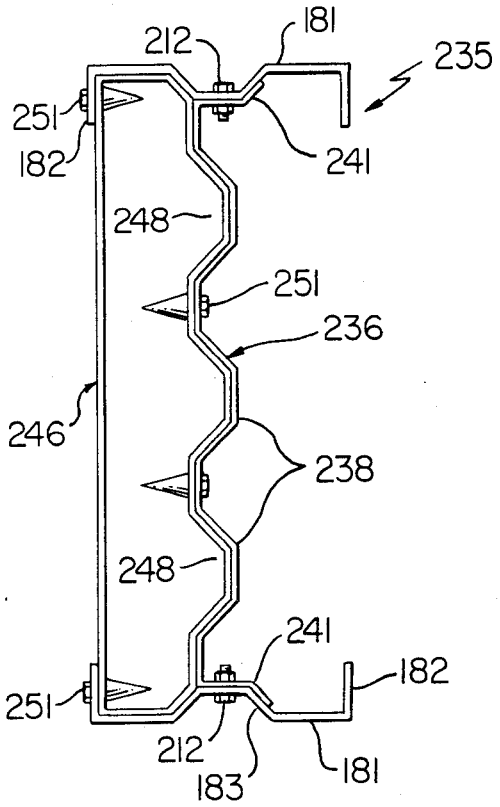
FIG. 20 is an end view of a modified beam constructed in accordance with another embodiment of the invention.

FIG. 20 shows a beam 235 which is constructed similar to the beam 175 described above in connection with FIG. 16. The beam 235 includes a sheet metal panel which forms a web portion 236 having longitudinally extending and vertically spaced ribs 238 forming a vertical corrugated cross-sectional configuration. The sheet metal panel extends to form upper and lower inner flange portions 241, and upper and lower outer flange portions of members 181 are connected to the inner flange portions 241 by spot welds or fasteners 184 which extend through the ribs 183 of the flange members 181.

In place of the sheet metal strut member 190, the beam 235 includes a series of longitudinally spaced strut members 246 which are molded from a metal or plastics material. As used herein, molding includes die casting of a metal as well as injection molding of a plastics material. Each of the strut members 246 extends vertically between the outer flange portions or members 181 and includes portions 248 which project into the ribs 238 of the corrugated web portion 236. Each strut member 246 is also provided with holes for receiving self-threading fasteners 251 which secure the strut member to the web portion 236 and to the flange portions 181. While the beam 235 is illustrated with a series of strut members 246 on only one side of the web portion 236, molded strut members may be used on both sides of the web portion 236 in longitudinally offset or alternating relation so that there is always convenient access for inserting the fasteners 251 which secure the strut members to the web portion 236.

Figure 21:
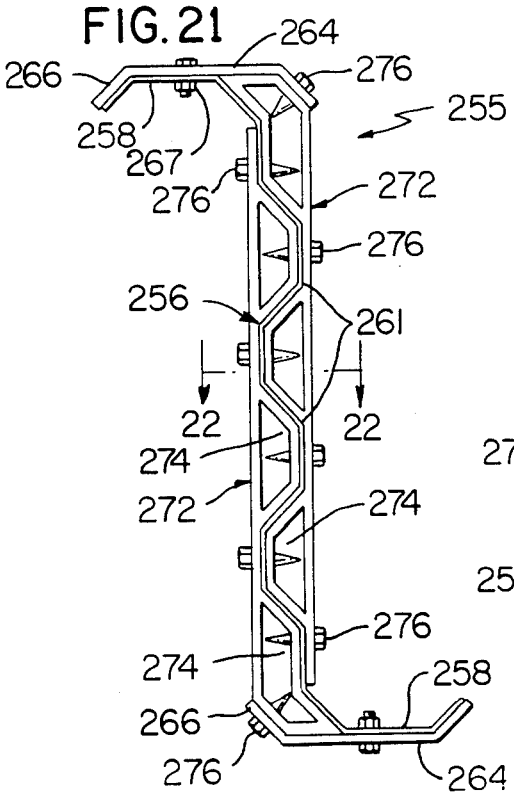
FIG. 21 is an end view of another embodiment of a purlin-type beam constructed in accordance with the invention.

Another Z-shaped purlin or beam 255 is shown in FIG. 21 and includes a thin sheet metal panel which forms a web portion 256 and upper and lower inner flange portions 258. The web portion 256 is corrugated to form vertically spaced and longitudinally extending ribs 261 each having a trapezoid cross-sectional configuration. Each of the inner flange portions 258 also has V-shaped ribs forming a trapezoid cross-sectional configuration. The beam 255 also includes upper and lower outer flange portions or members 264 which have a thickness substantially greater than the thickness of the web portion 256. For example, the web portion 256 may be formed of 24-gauge sheet steel, and the flange portions 264 may be formed from 17-gauge sheet steel.

The opposite edge portions 266 of each flange member 264 are formed or bent inwardly to provide the flange member with two V-shaped ribs forming a trapezoid cross-sectional configuration conforming to the shape of the adjacent inner flange portion 258. A series of longitudinally spaced bolts or fasteners 267 secure the corresponding upper and lower adjacent flange portions 258 and 264. Each fastener 267 may be provided with a countersunk flat head, or the flange portions may be attached by longitudinally spaced spot welds.

Figure 22:
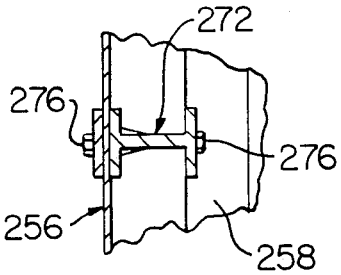
FIG. 22 is a fragmentary section taken generally along the line 22—22 of FIG. 21.

The purlin or beam 255 also includes longitudinally spaced pairs of strut members 272 each of which is molded of a metal or plastics material and has portions 274 which project into or between the ribs 261 of the web portion 256. Each pair of strut members 272 are secured together by self threading screws or fasteners 276 (FIG. 22) and clamp the web portion 256 between the strut members for positively maintaining the corrugated cross-sectional configuration of the web portion. Another series of longitudinally spaced fasteners 276 also secure the strut members 272 to the over-lapping edge portions 266 of the outer flange members 264.

While the fasteners 276 are shown with projecting head portions, the fasteners may have countersunk flat heads so that they do not project from the outer surfaces of the strut members 272. The strut members 272 may then serve as bumpers when a plurality of beams 255 are stacked in nesting relation.

Figure 23:
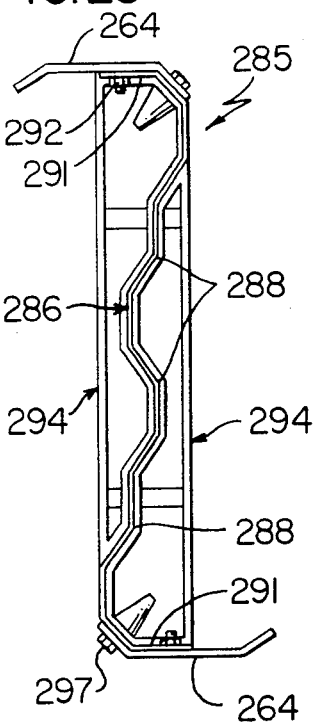
FIG. 23 is an end view of another modified purlin-type beam similar to the beam shown in FIG. 21 and also constructed in accordance with the invention.

FIG. 23 illustrates another Z-shaped purlin or beam 285 which is constructed in a manner similar to the beam 255. The beam 285 includes a sheet metal panel which forms a web portion 286 having longitudinally extending and vertically spaced ribs 288 each having a V-shaped cross-sectional configuration and thus provide the web portion 286 with another form of generally vertical corrugated cross-sectional configuration. The sheet metal panel also extends to form upper and lower inner flange portions 291 which are secured to outer flange portions or members 264 by longitudinally spaced fasteners 292 in the form of rivets or bolts or spot welds.

In reference to the beam 255 shown in FIG. 21, the upper outer flange portion or member 264 overlaps the lower outer flange portion or member 264, whereas in the beam member 285 shown in FIG. 23, both of the upper flange portions 291 and 264 overlap both of the lower flange portions. In a manner similar to the beam 255, the beam 285 includes a series of longitudinally spaced pairs of strut members 294 which are also molded of a metal or plastics material and include portions which project laterally into and between the ribs 288. Each pair of strut members 294 are clamped together by fasteners (not shown) which extend through aligned holes within the strut members and the web portion 286 so that the strut members 294 positively maintain the corrugated cross-sectional configuration of the web portion. Longitudinally spaced fasteners 297 also secure each pair of strut members 294 to both of the inner and outer flange portions 291 and 264.

Figure 24:
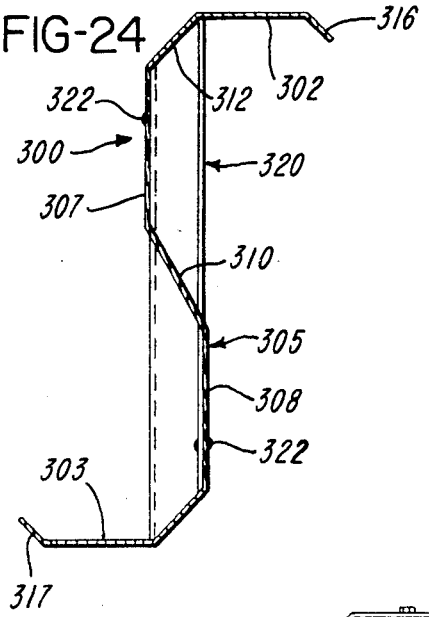
FIG. 24 is a section of a beam constructed in accordance with another embodiment of the invention.

Another sheet metal beam or purlin 300 constructed in accordance with the invention is shown in FIG. 24. In this embodiment, an upper flange portion 302 is integrally connected to a lower flange portion 303 by a web portion 305. The web portion includes laterally offset parallel flat sections 307 and 308 which are integrally connected by an inclined flat section 310. The web portion 305 also includes upper and lower edge portions or corner portions 312 and 313, respectively, which are inclined relative to the sections 307 and 308. The upper flange portion 302 and the lower flange portion 303 have inclined outer edge portions 316 and 317, respectively, and these edge portions cooperate with the corresponding edge or corner portions 312 and 313 to provide each of the upper and lower flange portions with a generally trapezoid cross-sectional configuration.

Figure 25:
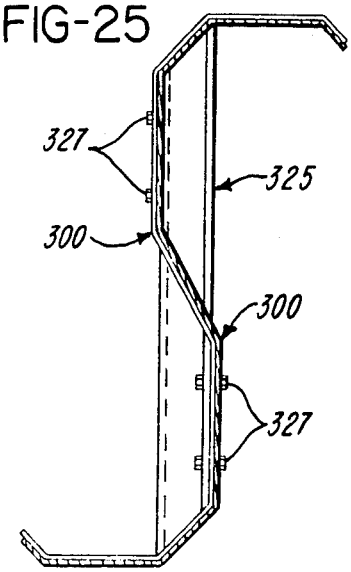
FIG. 25 is another section of the beam shown in FIG. 24 and showing an overlapping end joint between two beams.

Preferably, one of the upper or lower flange portions is slightly wider or larger than the outer flange portion so that by inverting one beam of two longitudinally aligned beams, the adjacent end portion may be overlapped as shown in FIG. 25, without springing the sheet metal. In a typical example of a beam or purlin 300, the sheet metal panel which forms the upper flange portion 302, the lower flange portion 303 and the web portion 305 is formed from 18 gauge steel and has an overall height of twelve inches.

A series of longitudinally spaced parallelogram-shape holes, similar to the holes 27 shown in FIG. 3, are formed within the flat inclined section 310 of the web portion 305, and each of the holes receives a strut member 320 which preferably has a Z-shape cross-sectional configuration similar to the strut member 29 described above in connection with FIGS. 1–3. The opposite ends of each strut member 320 are shaped to match the slope of the inclined corner sections or edge portions 312 and 313, and the flanges of each strut member 320 are rigidly secured to the web sections 307 and 308 by spot welds or suitable fasteners such as rivets 322. After the sheet metal panel is roll-formed to produce the flange and web portions of the beam 300, the strut members 320 are inserted into the corresponding holes within the inclined section 310. The strut members are then secured to the web portion 305 by the spot welds or rivets 322.

When it is desirable to overlap adjacent end portions of two aligned beams 300 in the construction of a building, a heavier guage strut member 325 (FIG. 25) may be inserted after the end portions of the aligned beams are overlapped at the building site. The strut members 325 are secured to the overlapping beams 300 by a set of bolts 327 which are inserted into aligned prepunched holes or holes which are drilled after the overlapping end portions of the two beams are set in position.

Figure 26:
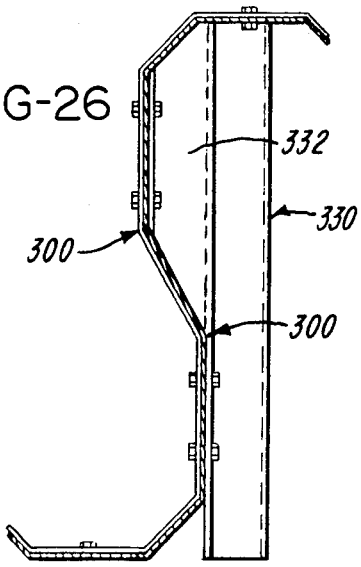
FIG. 26 is a section similar to FIG. 25 and showing a different strut member.

As shown in FIG. 26, the overlapping end portions of two aligned beams 300 may also be coupled together in the overlapping portion by a strut member 330 which is constructed somewhat similar to the strut member 190 described above in connection with FIG. 18. That is, each strut member 330 has generally a Z-shaped cross-sectional configuration with a laterally projecting L-shaped ear portion 332. A set of bolts 327 secure the strut member 330 to the web portions 305 of the overlapping beams 300. The strut members 330 does not need to extend through aligned prepunched holes within the inclined web sections 310 of the overlapping beams. In addition, each strut member 330 provides a greater resistance to roll over and aids in transmitting end shear loads from the roof to the frame.

The nesting ability of a stack of beams 300 is not quite as close or tight as the nesting ability of a stack of standard Z-shaped purlins, but is acceptable in view of the significant cost savings provided by the beam 300. The weight of metal or steel in a 12-inch 18-gauge beam 300 is about twenty-two percent less than the weight of a standard 8-inch 14-gauge purlin. In addition, a 12-inch beam 300 is slightly stronger and much stiffer in a vertical direction than a standard 8-inch purlin.

Figure 27:
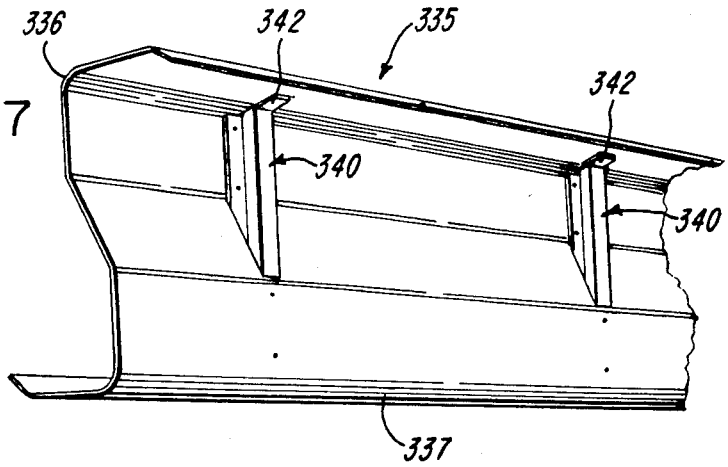
FIG. 27 is a perspective view of a portion of a modified beam similar to the beam shown in FIG. 24.

FIG. 27 illustrates a beam or purlin 335 which is constructed substantially the same as the beam or purlin 300 except that the edge or corner portions 336 and 337 are rounded instead of being flat and inclined as are the edge or corner portions 312 and 313 of the beam 300. The strut members 340 are constructed from sheet metal in the same manner as the strut members 320 except that the opposite end portions of each strut member are curved to conform to the curvature of the edge or corner portions 336 and 337. In addiition, the opposite end portions of each strut member 340 are provided with outwardly projecting tabs 342 which are secured by fasteners or spot welds to the overlying adjacent flange portions.

From the drawings and the above description, it is apparent that a sheet metal beam constructed in accordance with the present invention provides desirable features and advantages. For example, each of the beam constructions is initially formed of a relatively light gauge sheet metal panel having a thickness less than 0.040 inch and preferably about 0.024 inch. The sheet metal panel is formed in a manner which provides for utilizing the inherent strength of the sheet metal and to obtain a maximum strength/weight ratio. As a result, a beam constructed in accordance with the invention significantly reduces the cost for constructing a beam having a predetermined strength and thus makes more efficient use of the metal. The substantially higher strength/weight ratio of the beam also results in significantly reducing the weight of each linear foot of the beam from the weight of a conventional beam so that the beam of the invention may be more easily handled and more economically shipped than a conventional beam.

A beam constructed in accordance with the invention also provides for flexibility in design in that the height of the web portion of the beam may be selected or increased without substantially increasing the weight of the beam, thereby taking advantage of the fact that the strength of the beam increases as the square of the web height. Each of the beam embodiments also provides flange portions having large flat outer surfaces which are highly desirable for attaching the beams to a frame and for attaching overlying corrugated sheet metal panels to the beams with threaded fasteners.

The beam embodiments described in accordance with FIGS. 16–23 provide additional desirable features. For example, the strut members used in these embodiments include portions which project laterally into and between the ribs of the corrugated web portion and in conforming relation to the corrugations so that the corrugated shape of the web portion is positively maintained when the beam is loaded. As a result, the conforming strut members provide for minimizing the thickness of the sheet metal panel forming the corrugated web portion. The separate upper and lower outer flange portions in these beam embodiments also provide for selecting the gauge for the outer flange portions according to the design loading on the beams. The outer flange portions are also positively secured to the corresponding inner flange portions and to the strut members to provide a substantially rigid beam construction.

In the embodiments shown in FIGS. 21 and 23, the overlap of the flange portions is effective to reduce the roll-over moment and thereby improve the load carrying ability of a Z-shaped beam with only a small decrease in the nesting compactness of the beams in a stack. It is also apparent that each of the beams may be joined end-to-end with adjacent end portions in overlapping relation. In addition, the longitudinally spacing between adjacent strut members may be selected according to the design loads on the beam. As also disclosed in connection with FIGS. 16–23, the conforming strut members may be formed of sheet metal, die cast metal or injection molded plastics material, according to the particular use and load bearing requirements for the beam.

The sheet metal strut member 190 or also provides complete access for spot welding each strut member to the web portion and to the outer flange portions or for attaching rivets or other fasteners. While an I-beam is illustrated in FIG. 20, it is apparent that the construction could be used for producing C-beams, for example, to replace conventional C-beams used in the construction of metal buildings. As another feature, the longitudinally spaced pairs of double strut members in opposing relation not only function to clamp the corrugated web portion therebetween, but also function to carry the column loading between the upper and lower flange portions.

While the forms of beams herein described constitute preferred embodiments of the invention, it is to be understood that the invention is not limited to these precise forms of beams, and that changes may be made therein without departing from the scope and spirit of the invention, as defined in the appended claims.

The invention having been described, the following is claimed:

1. An elongated beam adapted for use in constructing a building and having a substantially high strength/-weight ratio, said beam comprising a sheet metal panel forming an upper flange portion integrally connected to a lower flange portion by a web portion, said web portion having laterally offset generally parallel sections connected by an inclined section, means defining a plurality of longitudinally spaced holes within said inclined section of said web portion, a plurality of longitudinally spaced strut members extending through corresponding said holes, and means securing said strut members to said web portion.

2. A beam as defined in claim 1 wherein said flange portions project in opposite directions from said web portion to provide said beam with a generally Z-shape cross-sectional configuration.

3. A beam as defined in claim 1 wherein each said strut member has a Z-shape cross-sectional configuration.

4. A beam as defined in claim 1 wherein said upper flange portion overlaps said lower flange portion by the distance between said laterally offset generally parallel sections.

5. A beam as defined in claim 1 wherein said securing means comprise a series of fasteners attaching said strut members to said offset generally parallel sections of said web portion.

6. A beam as defined in claim 1 wherein each of said upper and lower flange portions has a generally trapezoid cross-sectional configuration.

7. An improved elongated beam adapted for use in constructing a building and having a substantially high strength/weight ratio, said beam comprising a sheet metal panel having an upper edge portion integrally connected to a lower edge portion by a web portion, said web portion having laterally offset generally parallel sections connected by an inclined portion, an upper flange portion and a lower flange portion adjacent the corresponding said upper and lower edge portions, means rigidly connecting said upper and lower flange portions to the corresponding said upper and lower edge portions, a plurality of longitudinally spaced strut members extending generally vertically adjacent said web portion, said strut members including means projecting laterally adjacent said generally parallel sections of said web portion, and means securing said strut members to said web portion.

8. A beam as defined in claim 7 wherein each of said strut members is molded of a rigid material.

9. A beam as defined in claim 7 wherein said upper flange and edge portions of said lower flange and edge portions project laterally from said web portion in opposite directions to provide said beam with a generally Z-shaped cross-sectional configuration.

10. A beam as defined in claim 7 wherein each said strut member comprises a body of molded plastics material, and said body includes means defining holes for receiving self-threading fasteners to secure said strut members to said web portion.

11. A beam as defined in claim 7 and including second upper and lower flange portions comprising strips of sheet metal having a thickness greater than the thickness of said panel.

12. A beam as defined in claim 11 and including means securing said second flange portions to said strut members.

13. A beam as defined in claim 7 wherein said strut members are arranged in longitudinally spaced opposing pairs with said web portion confined therebetween.

14. A beam as defined in claim 7 wherein said web portion is confined between opposing pairs of said strut members, and fasteners extending through holes within said web portion to secure each pair of strut members.

15. A beam as defined in claim 7 wherein said upper and lower edge portions integrally connect the corresponding said web sections to said flange portions.

16. A beam as defined in claim 7 wherein said upper and lower edge portions are inclined relative to said generally parallel sections of said web portion.

17. An elongated beam adapted for use in constructing a building and having a substantially high strength/weight ratio, said beam comprising a sheet metal panel forming an upper flange portion integrally connected to a lower flange portion by a web portion, said web portion having laterally offset generally parallel sections connected by an inclined section, one of said flange portions being slightly smaller than the other said flange portion to provide for interfitting and overlapping relation of adjacent end portions of two of said beams, means defining a plurality of longitudinally spaced holes within said inclined section of said web portion, a plurality of longitudinally spaced strut members extending through corresponding said holes, and means securing said strut members to said web portion.

* * * * *